US010159880B1

(12) United States Patent
Mine et al.

(10) Patent No.: US 10,159,880 B1
(45) Date of Patent: Dec. 25, 2018

(54) ADJUSTABLE METAL WOOD GOLF CLUB HEAD WITH MOVEABLE WEIGHT STRUCTURE

(71) Applicant: MIZUNO CORPORATION, Osaka-shi, Osaka (JP)

(72) Inventors: Takayuki Mine, Norcross, GA (US); Kei Tsuji, Norcross, GA (US); David Llewellyn, Norcross, GA (US)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 15/658,751

(22) Filed: Jul. 25, 2017

(51) Int. Cl.
*A63B 53/04* (2015.01)
*A63B 53/06* (2015.01)
*A63B 60/04* (2015.01)

(52) U.S. Cl.
CPC ..... *A63B 60/04* (2015.10); *A63B 53/04* (2013.01); *A63B 53/0466* (2013.01); *A63B 53/06* (2013.01); *A63B 2053/0433* (2013.01); *A63B 2053/0495* (2013.01)

(58) Field of Classification Search
CPC ..... A63B 60/04; A63B 53/04; A63B 53/0466; A63B 53/06; A63B 2053/0433; A63B 2053/0495; A63B 2053/0491
USPC ..... 473/324–350, 287–292
See application file for complete search history.

(56) References Cited

U.S. PATENT DOCUMENTS 1,322,182 A 11/1919 Duncan
1,355,889 A 10/1920 Campbell
2,155,830 A 4/1939 Howard
3,680,868 A 8/1972 Jacob
3,912,277 A 10/1975 Pelz
4,423,874 A * 1/1984 Stuff, Jr. ..... A63B 69/3685 473/338
4,530,505 A 7/1985 Stuff
(Continued)

FOREIGN PATENT DOCUMENTS

JP H07163685 A 6/1995
JP 2006320493 A 11/2006
(Continued)

OTHER PUBLICATIONS

Extended European Search Report in Related EP Application No. 15164335.0, dated Aug. 12, 2015, 8 pages.
(Continued)

*Primary Examiner* — Sebastiano Passaniti
(74) *Attorney, Agent, or Firm* — Troutman Sanders LLP; Daniel Sharpe

(57) ABSTRACT

An adjustable golf club head and weight structure is disclosed. The adjustable golf club head can include a crown, a toe, a hosel, and a sole. The sole of the club head may have one or more tracks located thereon. Each of the one or more tracks can have one or more weights secured therein. Each of the one or more weights can include an upper weight portion, and a lower weight portion. A screw can be positioned to adjoin the upper weight portion and the lower weight portion. The weight can also include a clip fastened to the screw such that the clip retains the screw within bores located in the upper and lower weight portions. In order to prevent the upper and lower weight portions from rotating with respect to one another, the weight can include an alignment portion and an alignment receptacle.

8 Claims, 4 Drawing Sheets

(56) References Cited

U.S. PATENT DOCUMENTS

| | | | | |
|---|---|---|---|---|
| 5,213,329 | A | 5/1993 | Okumoto et al. | |
| 5,230,509 | A | 7/1993 | Chavez | |
| 5,257,786 | A | 11/1993 | Gorman | |
| 5,441,274 | A * | 8/1995 | Clay | A63B 53/065 473/201 |
| 5,720,674 | A | 2/1998 | Galy | |
| 5,938,540 | A | 8/1999 | Lu | |
| 5,989,134 | A | 11/1999 | Antonious | |
| 6,056,649 | A | 5/2000 | Imai | |
| 6,123,627 | A | 9/2000 | Antonious | |
| 6,277,032 | B1 | 8/2001 | Smith | |
| 6,991,560 | B2 | 1/2006 | Tseng | |
| 7,166,041 | B2 | 1/2007 | Evans | |
| 7,186,190 | B1 | 3/2007 | Beach et al. | |
| 7,572,193 | B2 | 8/2009 | Yokota | |
| 7,611,424 | B2 | 11/2009 | Nagai et al. | |
| 7,637,823 | B2 * | 12/2009 | Shimazaki | A63B 53/0466 473/332 |
| 7,806,782 | B2 | 10/2010 | Stites et al. | |
| 7,824,280 | B2 | 11/2010 | Yokota | |
| 8,016,694 | B2 | 9/2011 | Llewellyn et al. | |
| 8,057,323 | B2 | 11/2011 | Liang et al. | |
| 8,444,505 | B2 | 5/2013 | Beach et al. | |
| 8,696,491 | B1 | 4/2014 | Myers | |
| 9,216,333 | B2 * | 12/2015 | Bezilla | A63B 53/06 |
| 9,238,162 | B2 | 1/2016 | Breier et al. | |
| 9,387,376 | B1 * | 7/2016 | Hall | A63B 53/06 |
| 9,498,686 | B2 * | 11/2016 | Breier | A63B 53/0466 |
| 9,694,261 | B2 * | 7/2017 | Nunez | A63B 53/06 |
| 9,700,767 | B2 * | 7/2017 | Zimmerman | A63B 53/0466 |
| 9,724,577 | B1 * | 8/2017 | Kingston | A63B 53/06 |
| 9,914,028 | B1 * | 3/2018 | Cleghorn | A63B 53/0466 |
| 2006/0105856 | A1 | 5/2006 | Lo | |
| 2006/0122004 | A1 | 6/2006 | Chen et al. | |
| 2006/0240903 | A1 | 10/2006 | Cardosi | |
| 2006/0240908 | A1 | 10/2006 | Adams et al. | |
| 2007/0178988 | A1 | 8/2007 | Tavares et al. | |
| 2008/0119303 | A1 | 5/2008 | Bennett et al. | |
| 2008/0146370 | A1 | 6/2008 | Beach et al. | |
| 2008/0261715 | A1 | 10/2008 | Carter | |
| 2011/0070969 | A1 | 3/2011 | Stevens et al. | |
| 2013/0090185 | A1 | 4/2013 | Boyd et al. | |
| 2014/0018185 | A1 | 1/2014 | Mizutani | |
| 2014/0080628 | A1 | 3/2014 | Sargent et al. | |
| 2014/0248976 | A1 | 9/2014 | Stokke | |
| 2015/0321055 | A1 * | 11/2015 | Golden | A63B 53/0466 473/338 |
| 2017/0312593 | A1 * | 11/2017 | Myers | A63B 53/0466 |

FOREIGN PATENT DOCUMENTS

| | | | |
|---|---|---|---|
| TW | M272559 | U | 8/2005 |
| WO | 2013028889 | A1 | 2/2013 |

OTHER PUBLICATIONS

EPO Communication and Annex Pursuant to Article 94(3) EPC in Related EP Application No. 15164335.0, dated Jul. 2016, 5 pages.

* cited by examiner

ADJUSTABLE METAL WOOD GOLF CLUB HEAD WITH MOVEABLE WEIGHT STRUCTURE

BACKGROUND OF THE INVENTION

1. Field of the Invention

The present invention relates generally to golf clubs, and more particularly to weight structures for adjustable metal wood golf clubs.

2. Background of Related Art

Golfers have many different swing types. This variety in swing types means that different golfers contact the ball in different ways. Each different swing can impart a different spin and/or flight trajectory to the ball. The ball may "draw" or "fade," for example, based on the type of swing the golfer uses. Similarly, the ball may have a trajectory that varies with the spin rate of the ball following contact. A ball with a higher spin rate may rise more after contact than a ball with a lower spin rate would rise. These different trajectories can be desirable when intended and undesirable when unintended.

Golfers' strokes also can change over time. A golfer who previously contacted the ball such that the ball would rise and draw, for example, may modify his swing or stance so that he contacts the ball such that the ball rises less and fades. If the golfer's club is set up to correct a particular swing, and that swing changes, the club may no longer be suitable for the golfer. Adding the ability to adjust a club allows the club to change with the golfer's swing and provide the desired contact and trajectories.

In addition to a golfer's swing, the physical specifications, or inherent characteristics of the club head may also influence trajectory. In general, for a metal wood head, as the center of gravity ("COG") is located further from the shaft axis the club is more fade biased. Conversely, as the COG is located closer to the shaft axis the head is more draw biased. Similarly, a COG located nearer the face may tend to reduce spin and lower the effects of lift force on the ball thus promoting a lower ball flight. The opposite is true for a COG that more rearward (further from the face).

A golfer may desire more distance on the trajectory of his shots. Since the rules of golf limit the spring like effect from the face, an alternate way of generating more distance is to optimize the ball launch for spin and launch angle. This condition allows the ball to fly further and straighter due to improved aerodynamic performance. Having an improved COG location optimized for each individual golfer can improve the launch conditions of the ball, thus having an adjustable weight/COG metal wood can provide additional distance if the player can easily and intuitively find their appropriate weight setting. Traditional golf clubs have predetermined weighting, which results in a fixed COG location. Thus, the clubs cannot be easily modified to compensate for issues with a golfer's swing, such as, for example, unintended draw or fade.

Some prior attempts to address this problem have involved adjustable weight drivers that make use of weight screws. One of the weakness of such systems is that weight screws are not efficient for weight movement, since swapping positions of a first screw with mass A with another screw with mass B results in a net mass movement of A-B. This inefficiency often requires significant weight to be added and subtracted from a club, which may have undesirable effects on other characteristics of the club's performance.

Other attempts to address this problem include single-track systems. In these systems, the track may follow the skirt of the driver in an attempt to be more efficient than using weight screws for weight displacement, but they still lack the ability to isolate the weight movement in the front/back and toe/heel direction, leading to less intuitive self optimization. Some single-track systems that are parallel to the face and in close proximity to the face have little or no ability to adjust COG depth and are likely very front weighted due to the mass of the track, thus no ability to increase spin and trajectory height by COG adjustment in the front/back direction. Current single-track systems also tend to have closed-ended tracks. Tracks with closed ends, however, do not allow for easy movement of the weights from one track to another if the golfer needs more weight in a given area of the head. Additionally, close ended tracks are more difficult and expensive to produce.

Adjustable golf clubs that allow the weight of the golf club head to be independently moved in the heel/toe and front/rear directions have recently emerged in the golf club marketplace. The clubs are generally adjustable so that the spin and fade/draw characteristics can be adjusted independently. Additionally, weights are able to be easily and securely engaged with the club head. However, many of these adjustable golf clubs use a weight structure that makes use of a set screw weight design. Such a weight structure typically requires the weight to have a set screw that presses directly on a bottom surface of a track. Because this bottom surface of the track forms a portion of the sole of the club head, the surface must be reinforced such that it can bear the stress of having a set screw or set screws repeatedly tightened into it as the weights are adjusted. This reinforcement adds weight and manufacturing costs to the club head.

What is needed is a club head and weight structure that reduce the stresses on the club head track surfaces, so that the sole need not be reinforced to bear the stresses of a set screw. It is to such a golf club head and weight structure that embodiments of the present invention are primarily directed.

BRIEF SUMMARY OF THE INVENTION

Embodiments of the present disclosure relate to an adjustable golf club head and associated weight structure. In some embodiments, the club can be adjusted by moving weights within tracks located on the sole of the club. An adjustable golf club head according to the present disclosure can have a crown, a toe, a hosel, and a sole. The sole of the golf club head can include one or more open ended tracks located on the sole such that each track can receive one or more weights.

In some embodiments, the one or more weights can comprise an upper weight portion and a lower weight portion, each having a bore therethrough. In some embodiments, the one or more weights each include a screw positioned to adjoin the upper weight portion and the lower weight portion by passing through the upper and lower bores. The weight is configured such that the screw does not directly contact any portion of the track or sole. In some embodiments, the one or more weights further comprise a clip fastened to the lower end of the screw, to retain the screw within the bores of the upper and lower weight portions. In some embodiments, the one or more weights can also include an alignment portion and an alignment receptacle, in an arrangement such that the alignment portion cooperates with the alignment receptacle in order to prevent rotation of the upper and lower weight portions.

In some embodiments, the tracks located on the sole of the club head can comprise two rails on either side of the track. When the one or more weights are installed into the club head, the two rails can be positioned between the upper and lower weight portions. Rotation of the screw can cause the lower weight portion to move towards the upper weight portion, such that the upper and lower weight portions abut and clamp onto the two rails.

These and other objects, features, and advantages of the present invention will become more apparent upon reading the following specification in conjunction with the accompanying drawing figures.

DETAILED DESCRIPTION OF THE INVENTION

Embodiments of the present invention relate generally to golf clubs, and more particularly to weight structures for adjustable metal wood golf clubs. In some embodiments, a golf club can be adjusted by moving weights positioned in tracks located on the sole and proximate the heel of the club head. The weights include a screw that allows the weight to be tightened and loosened to be positioned as desired along the track or tracks on the sole. In this manner, the user can adjust the club.

To simplify and clarify explanation, the invention is described herein as an adjustable golf club. One skilled in the art will recognize, however, that the invention is not so limited.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention.

As described above, a general problem with conventional adjustable golf clubs is that the weight structures typically employed require the weight to have a set screw that presses directly on a bottom surface of a track. This can require the sole and the track to be reinforced with thicker walls and/or support ribs in order to reliably withstand the stress applied by the set screw. This can add undesired weight and limit the ability to locate the COG as desired. In turn, this may restrict the golfer's ability to set the COG location to obtain desired fade, draw, and spin for his or her particular swing type.

As shown in FIGS. 1-4, embodiments of the present disclosure can comprise an adjustable golf club head. More specifically, embodiments of the present disclosure can comprise an adjustable golf club head and weight structure that does not require the tracks positioned on the sole to be reinforced, but still allows the weights to be easily adjusted throughout the full track range.

Figure 1:
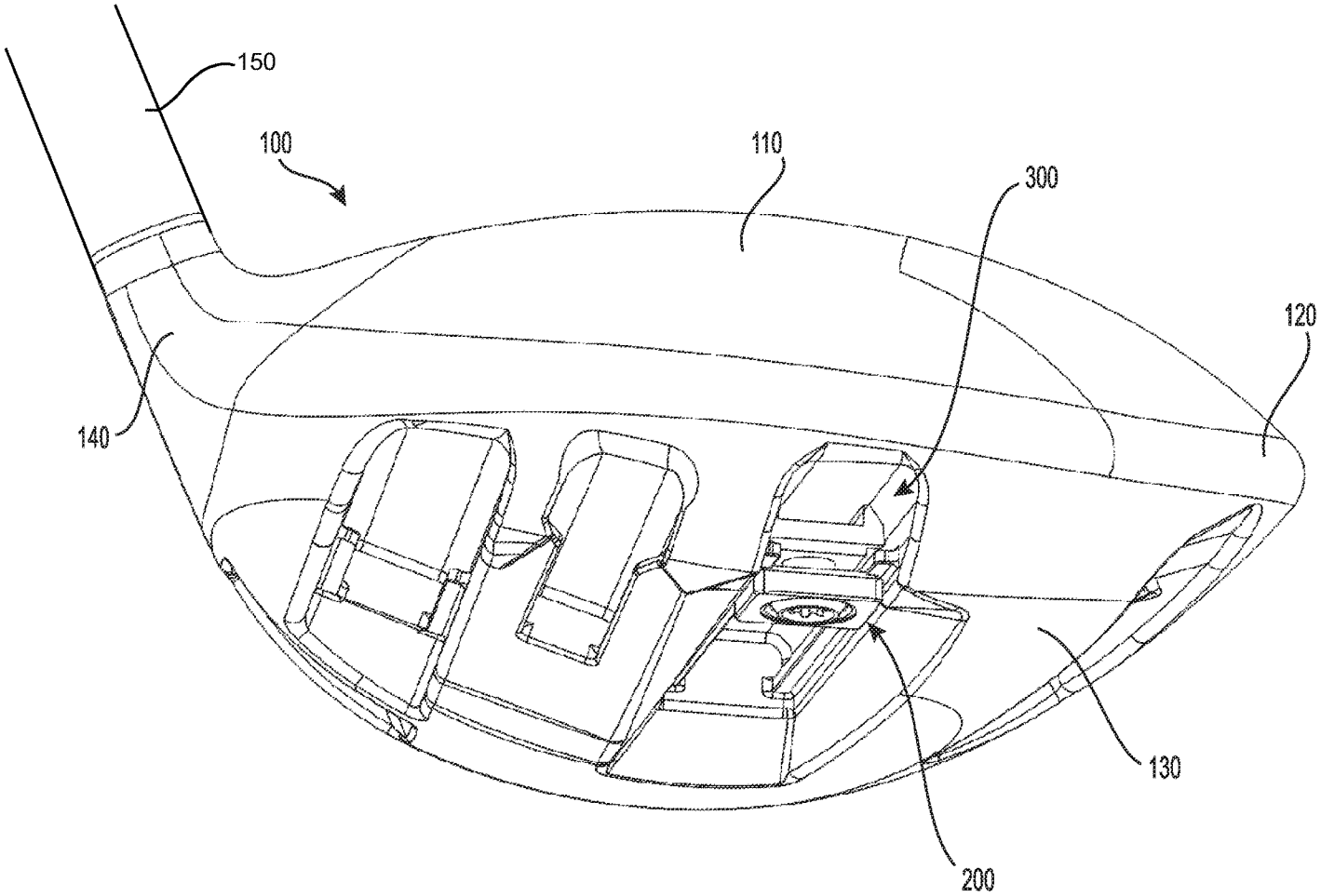
FIG. 1 depicts an adjustable golf club head and weight structure, in accordance with some embodiments of the present disclosure.

In some embodiments, as shown in FIG. 1, the adjustable golf club head 100 can comprise a crown 110, a toe 120, a sole 130, a hosel 140, and a shaft 150. Sole 130 of head 100 can have one or more weights 200 secured along one or more tracks 300. Weights 200 can weigh, for example and not limitation, between approximately 3 g and 9 g. In some embodiments, weights 200 weigh approximately 6 g. Of course, other weight sizes and weights can be used and are contemplated herein.

Figure 2:
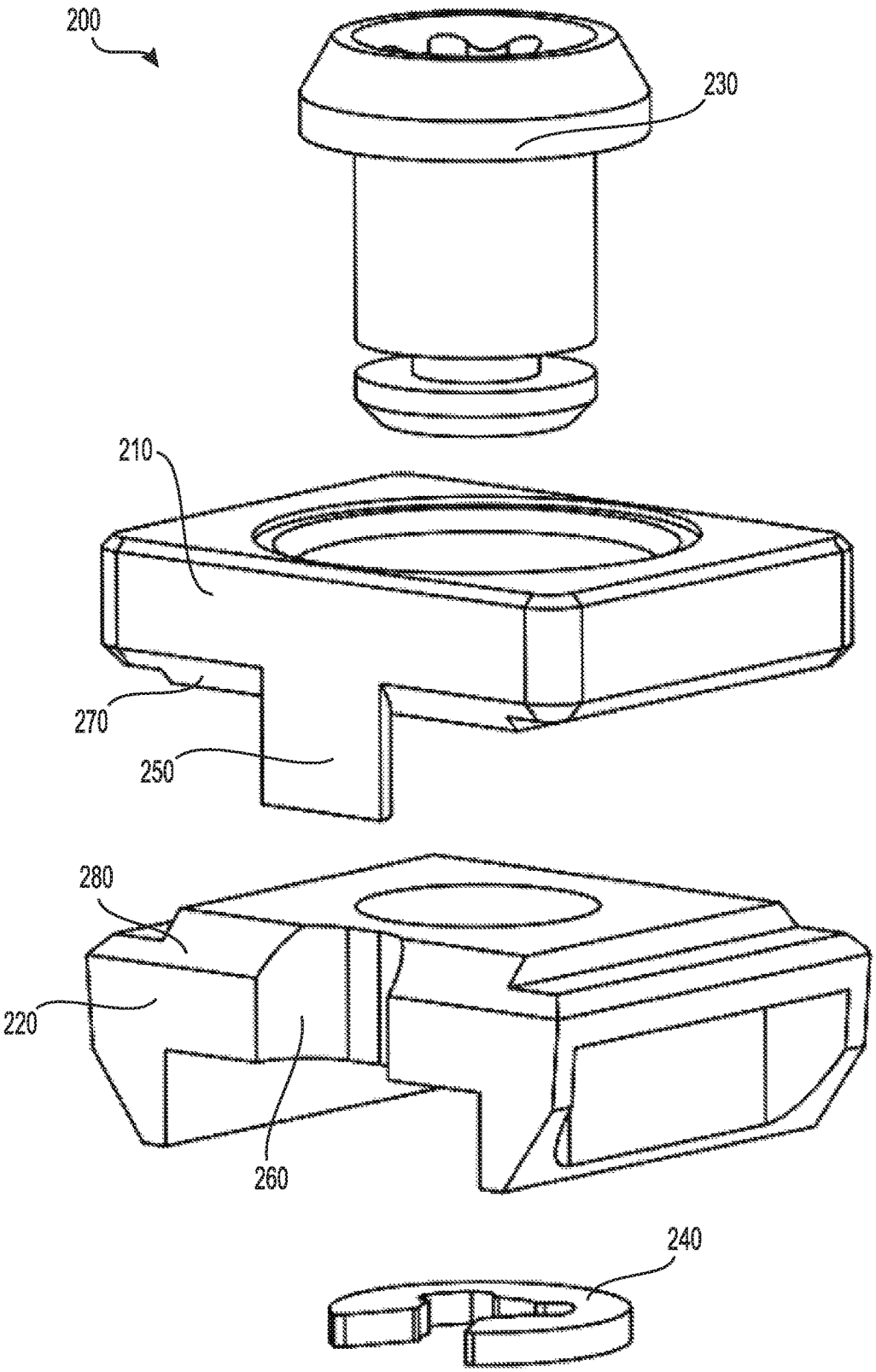
FIG. 2 depicts an exploded view of the adjustable golf club head weight structure, depicted in FIG. 1.

An exploded view of weight assembly 200 is illustrated in FIG. 2. Weight 200 can have an upper weight portion 210, a lower weight portion 220, and a screw 230 positioned through bores in the weight portions and threadably engaged to adjust the distance between the upper and lower weight portions. In order to prevent screw 230 from being overly loosened, which could cause the upper and lower weight portions to separate, clip 240 can be fastened to the lower end of the screw. In some embodiments in accordance with the present disclosure, screw 230 may have an integrally formed feature to cooperate with or serve substantially the same purpose as clip 240 in order to prevent components of weight 200 from separating from each other.

As shown in FIG. 2, weight 200 may have one or more alignment features in order to maintain alignment of the upper and lower weight portions with respect to one another and track 300. In some embodiments, upper weight portion 210 can be provided with an alignment portion 250, and lower weight portion 220 can be provided with alignment receptacle 260. The cooperation and/or abutment of alignment portion 250 and alignment receptacle 260 can prevent the upper and lower weight portions from rotating about the axis of screw 230, and restricting their relative motion to moving toward each other or away from each other, depending on the direction in which screw 230 is rotated. This alignment is important for the structure and function of weight 200, since rotation about the axis of screw 230 could prevent weight 200 from properly and securely engaging track 300 of club head 100. Improper or loose engagements between weight 200 and track 300 could result in weight 200 separating from club head 100 and causing damage or injury to the golf course, players, or the club itself.

In order to aid the user's installation of weight 200 into club head 100, weight 200 may be provided with upper and lower chamfers 270 and 280, respectively. Upper and lower chamfers 270 and 280 can be shaped to cooperate with the dimensions and features of track 300 so that the user need not perfectly align weight 200 with track 300 during the installation process. Providing this additional leeway in alignment for the weight installation allows weight 200 to be securely installed and adjusted, for example, while the user is on a golf course and/or wearing gloves. Chamfers 270 and 280 can be provided on one or both sides of weight 200 to allow easier installation in one or both directions.

Figure 3:
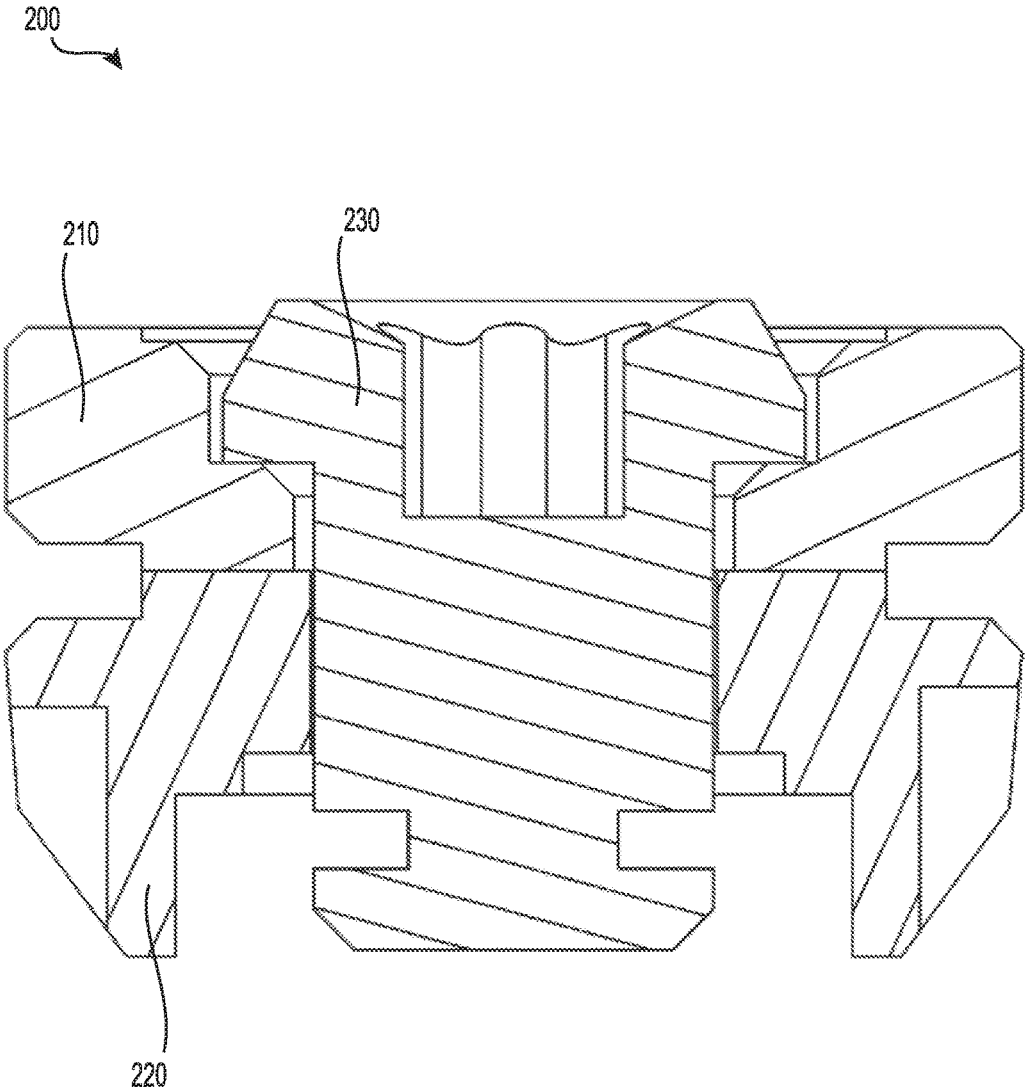
FIG. 3 depicts a cross sectional view of the adjustable golf club head weight structure depicted in FIG. 2.

As illustrated in FIG. 3, weight 200 is assembled such that upper weight portion 210 and lower portion 220 are maintained in a substantially parallel orientation, with screw 230 passing through bores in each of the weight portions. Screw 230 threadably engages one or both of the upper and lower weight portions to allow the distance between them to be adjusted such that weight 200 can be secured along track 300.

Figure 4:
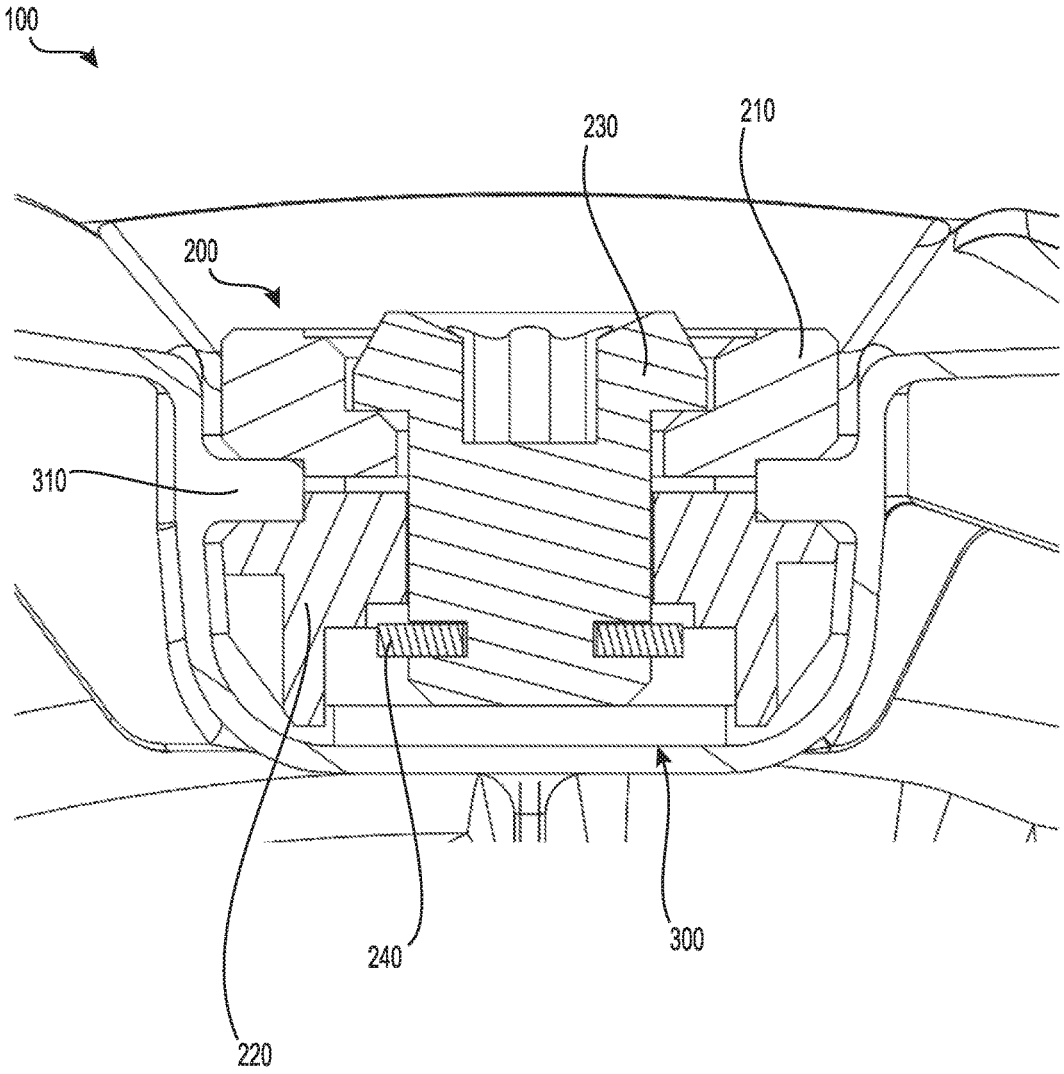
FIG. 4 depicts a cross sectional view of the adjustable golf club head weight structure depicted in FIG. 2 as installed in an adjustable golf club head.

FIG. 4 illustrates a cross section of weight 200 in an installed position along track 300. Track 300 can include rails 310 on either side of the track for weight 200 to clamp onto. In the installed position, weight 200 can be secured along track 300 by tightening screw 230 such that upper and lower weight portions 210, 220 apply pressure to opposing faces of rails 310. Once screw 230 is appropriately tightened, friction between upper and lower weight portions 210, 220 and rails 310 of track 300 acts to retain weight 200 in a desired position along track 300. Weight 200 is designed such that screw 230 does not contact or apply any force directly to sole 130. Rails 310 can have a height that is substantially equal to a height of each of the upper and lower chamfers 270 and 280. This geometry can allow the upper and lower chamfers 270 and 280 to better cooperate with rails 310 and aid the user in the installation of weight 200 onto track 300.

In practice, weight 200 can initially be adjusted to a loosened state, with the distance between the upper and lower weight portions 210, 220 exceeding the thickness of rails 310. A user can then slide weight 200 into the open end of a track 300, and slide weight 200 to a desired position along track 300. The user can then tighten screw 230, thereby moving upper weight portion 210 and lower weight portion 200 towards one another, until the upper and lower weight portions 210, 220 abut and apply pressure to opposing surfaces of rails 310. The user may then evaluate the weight balance of club head 100 to ensure it is suitable for play, or simply begin play.

In some embodiments contemplated by the present disclosure, club head 100 can have a plurality of markings along the track 300 on sole 130 in order to allow the position of weight 200 to be accurately measured and/or adjusted. These markings may take the form of graduations as on a ruler, suggested settings (i.e., based on a series of recommended settings), or some combination thereof.

While several possible embodiments are disclosed above, embodiments of the present invention are not so limited. For instance, while several possible configurations have been disclosed (e.g., embodiments with a plurality tracks in various arrangements), other suitable track configurations and weights could be selected without departing from the spirit of embodiments of the invention. In addition, the location and configuration used for various features of embodiments of the present invention can be varied according to a particular golf club that requires a slight variation due to, for example, the size or construction of the golf club, the user, or cost issues. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. An adjustable golf club head comprising:

a crown, a toe, a hosel, and a sole;

one or more open ended tracks located on the sole; and one or more weights secured on each of the one or more tracks located on the sole, wherein each of the one or more weights comprises:

an upper weight portion having an upper bore therethrough;

a lower weight portion having a lower bore therethrough;

a screw positioned to adjoin the upper weight portion and the lower weight portion by passing through the upper and lower bores, and having an upper end and a lower end;

a clip fastened to the screw at the lower end, such that the clip retains the screw within the upper and lower bores;

an alignment portion and an alignment receptacle, such that the alignment portion is located on one of the upper and lower weight portions, and the alignment receptacle is located on the other one of the upper and lower weight portions;

wherein the alignment portion cooperates with the alignment receptacle in order to prevent rotation of the upper and lower weight portions;

an upper chamfer provided on the upper weight portion, and a lower chamfer provided on the lower weight portion;

wherein the screw is positioned so as to not contact any portion of the tracks or the sole in an installed position;

wherein each of the one or more tracks located on the sole further comprises a first and second track rail; and wherein a height of each of the upper and lower chamfers is substantially equal to a height of the first and second track rails.

2. The adjustable golf club head of claim 1, wherein the first and second track rails are positioned between the upper and lower weight portions of the one or more weights.

3. The adjustable golf club head of claim 2, wherein rotation of the screw causes the lower weight portion to move towards the upper weight portion.

4. The adjustable golf club head of claim 3, wherein rotation of the screw causes the lower weight portion and the upper weight portion to abut the first and second track rails.

5. A golf club comprising:

an adjustable golf club head having a crown, a toe, a hosel, and a sole;

a shaft connected to the hosel;

one or more open ended tracks located on the sole; and one or more weights secured on each of the one or more tracks located on the sole, wherein each of the one or more weights comprises:

an upper weight portion having an upper bore therethrough;

a lower weight portion having a lower bore therethrough;

a screw positioned to adjoin the upper weight portion and the lower weight portion by passing through the upper and lower bores, and having an upper end and a lower end;

a clip fastened to the screw at the lower end, such that the clip retains the screw within the upper and lower bores;

an alignment portion and an alignment receptacle, such that the alignment portion is located on one of the upper and lower weight portions, and the alignment receptacle is located on the other one of the upper and lower weight portions;

wherein the alignment portion cooperates with the alignment receptacle in order to prevent rotation of the upper and lower weight portions;

an upper chamfer provided on the upper weight portion, and a lower chamfer provided on the lower weight portion;

wherein the screw is positioned so as to not contact any portion of the tracks or the sole in an installed position;

wherein each of the one or more tracks located on the sole further comprises a first and second track rail; and wherein a height of each of the upper and lower chamfers is substantially equal to a height of the first and second track rails.

6. The golf club of claim 5, wherein the first and second track rails are positioned between the upper and lower weight portions of the one or more weights.

7. The golf club of claim 6, wherein rotation of the screw causes the lower weight portion to move towards the upper weight portion.

8. The golf club of claim 7, wherein rotation of the screw causes the lower weight portion and the upper weight portion to abut the first and second track rails.

* * * * *